United States Patent [19]

Kamon et al.

[11] 4,291,205

[45] Sep. 22, 1981

[54] LAMINATED LOUDSPEAKER DIAPHRAGM WITH HONEYCOMB CORE AND DAMPING LAYERS

[75] Inventors: Yoshiyuki Kamon, Yokohama; Jun Kishikami, Urawa, both of Japan

[73] Assignee: Sony Corporation, Tokyo, Japan

[21] Appl. No.: 75,492

[22] Filed: Sep. 13, 1979

[30] Foreign Application Priority Data

Sep. 19, 1978 [JP] Japan ..... 53-114892

[51] Int. Cl.[3] ..... H04R 7/10

[52] U.S. Cl. ..... 179/181 R; 179/115 R; 181/167

[58] Field of Search ..... 179/181 R, 115 R, 171, 179/167

[56] References Cited

U.S. PATENT DOCUMENTS

| | | | |
|---|---|---|---|
| 4,020,299 | 4/1977 | Garner et al. | 179/181 R |
| 4,140,203 | 2/1979 | Niguchi et al. | 181/167 |
| 4,198,550 | 4/1980 | Matsuda et al. | 179/181 R |

*Primary Examiner*—Glen R. Swann, III

*Attorney, Agent, or Firm*—Lewis H. Eslinger; Alvin Sinderbrand

[57] ABSTRACT

A diaphragm for an electro acoustic transducer, such as a loudspeaker, includes first and second parallel sheet members, a honeycomb core member sandwiched between the sheet members, and a damping layer interposed between each sheet member and the honeycomb core member for increasing the internal energy loss of the diaphragm.

10 Claims, 5 Drawing Figures

LAMINATED LOUDSPEAKER DIAPHRAGM WITH HONEYCOMB CORE AND DAMPING LAYERS

BACKGROUND OF THE INVENTION

1. Field of the Invention

This invention relates generally to a diaphragm for a loudspeaker and, more particularly, to a diaphragm for a loudspeaker having a high internal energy loss.

2. Description of the Prior Art

In general, a diaphragm for an electro acoustic transducer such as a loudspeaker should have a large ratio of modulus of elasticity E to density $\rho$ ($E/\rho$) thereof so as to increase its range of motion in the direction of the piston or bobbin. Further, in order to have a relatively smooth frequency characteristic in the high frequency region, the diaphragm should have a suitable internal energy loss.

It is generally known that a diaphragm with a honeycomb core structure has a relatively large ratio of modulus of elasticity to density $E/\rho$. Such diaphragms are typically formed of a pair of parallel sheet members made from, for example, aluminum, beryllium or other metal foil or a carbon or other (FRP) fiber reinforced plastic (CFRP) with a honeycomb core member made of, for example, aluminium foil, is sandwiched between the sheet members. Such a diaphragm is generally lightweight with a high rigidity, that is, the ratio of modulus of elasticity to density $E/\rho$, is high. However, it has a small internal energy loss. Therefore, it has a high resonance sharpness in the high frequency band. Thus, it is seen that it becomes very difficult to satisfy all of the above conditions of low density, high rigidity and high internal energy loss in a diaphragm of the type having a honeycomb core structure.

OBJECTS AND SUMMARY OF THE INVENTION

Accordingly, it is an object of the present invention to provide a diaphragm for a loudspeaker that avoids the above-described difficulties encountered with the prior art.

More particularly, it is an object of this invention to provide a diaphragm for a loudspeaker which is formed from a honeycomb core member and two sheet members, the combination having a low density and high rigidity; that is, a high ratio of modulus of elasticity to density and, is further formed from a sheet made of a soft elastic material inserted between the core member and sheet members, in order to increase the internal energy loss at the junction portion therebetween.

It is a further object of this invention to provide a method of making a diaphragm of a honeycomb core structure having a high ratio of modulus of elasticity to density and a high internal energy loss.

In accordance with an aspect of this invention, a diaphragm for an electro acoustic transducer comprises first and second sheet members, a honeycomb core member sandwiched between the first and second sheet members, and a damping layer interposed between each sheet member and the core member for increasing the internal energy loss of the diaphragm.

The above, and other objects, features and advantages of the invention, will be apparent from the following detailed description of an illustrative embodiment of the invention which is to be read in connection with the accompanying drawings.

DESCRIPTION OF THE PREFERRED EMBODIMENT

Figure 1:
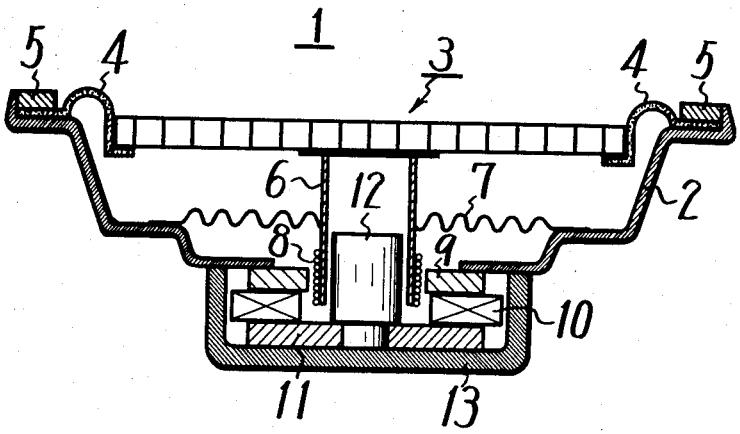
FIG. 1 (PRIOR ART)
FIG. 1 is a schematic cross-sectional view of a known flat plate type speaker with a diaphragm having a honeycomb core structure, to which the present invention can be applied.
Figure 2:
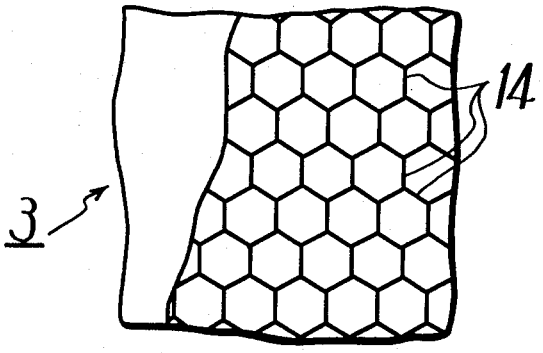
FIG. 2 (PRIOR ART)
FIG. 2 is a partially cut-away plan view of a section of the prior art diaphragm of FIG. 1.

Referring to the drawings in detail, and initially to FIG. 1 thereof, there is schematically shown a known loudspeaker 1 including a frame 2, a diaphragm 3 having a honeycomb core structure and which is located in a open portion of frame 2, an edge member 4 which supports diaphragm 3, and a gasket 5 for securing edge member 4 to frame 2. The loudspeaker also includes means for driving the diaphram, including a coil bobbin 6, a damper 7 for supporting coil bobbin 6, a voice coil 8, yoke plate 9, a magnet 10, a yoke 11, a pole piece 12, and a cover 13 for covering the driving means. As shown in FIGS. 1 and 2, diaphragm 3 has a core member 14 of a honeycomb structure which is well known in the art.

Figure 3:
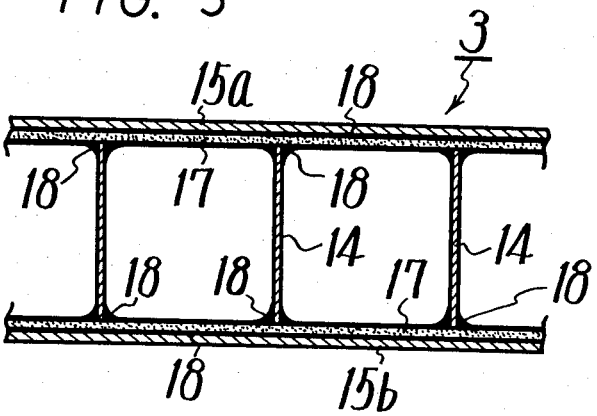
FIG. 3 is an enlarged cross-sectional view of a portion of a diaphragm according to the present invention.

Referring to FIG. 3, one embodiment of a diaphragm according to the present invention will now be described. As shown in FIG. 3, diaphragm 3 according to this invention is formed of first and second parallel sheet members **15*a* and 15*b* which may be made from any structurally suitable material, such as aluminum foil, aluminum alloy foil, titanium foil, titanium alloy foil, beryllium foil, beryllium alloy foil or the like. A honeycomb core member 14 made from, for example aluminium foil or other suitable metal foil, is sandwiched between first and second sheet members 15*a* and 15*b*, and a thin damping layer 17, of a soft resilient material, such as a urethane foamed plastic or rubber is disposed between core member 14 and each sheet member 15*a* and 15*b*. It is to be noted that a material having a very flexible and resilient characteristic is defined in this application as a damping material. Core member 14, damping layer 17 and sheet members 15*a* and 15*b* are fixedly bonded together by a suitable adhesive agent 18, for example from the group polyamide group as shown in FIG. 3**.

Figure 4:
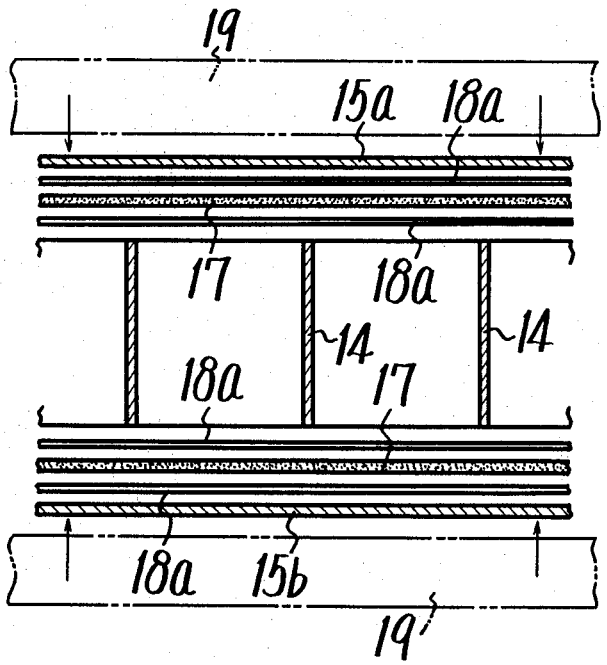
FIG. 4 is a schematic cross sectional view used for explaining a method of making the diaphragm of FIG. 3.

Turning to FIG. 4, one example of a method of making the diaphragm of FIG. 3, according to the present invention, will now be described. In this method, the above adhesive agent 18 is in the form of a commercially available hot-melt-sheet **18*a*. A plurality of hot-melt-sheets 18*a* are then disposed between each damping layer 17, sheet members 15*a* and 15*b* and the upper and lower surfaces of core member 14, as shown in FIG. 4. The entire assembly is then pressed together by a heating plate 19, shown in FIG. 4 by a two-dot chain line. In this manner, since pressure and heat are simultaneously applied to the various layers, core member 14, damping layer 17 and sheet members 15***a* and 15*b* are integrated in one step. Accordingly, it is seen that this method becomes very advantageous when the above diaphragm is mass-produced. However, it is to be noted that the present invention is not limited to the above method of making the diaphragm of FIG. 3, but also is directed to the diaphragm construction.

The diaphragm of this invention, made by the above method, not only has a low density and high rigidity, that is, high ratio of modulus of elasticity to density due to the combination of the honeycomb core member and sheet member but also has a sufficiently large internal energy loss due to the soft damping material of the damping layer disposed between the honeycomb core member and sheet members. That is, the diaphragm of this invention satisfies all of the above-recited conditions.

Figure 5:
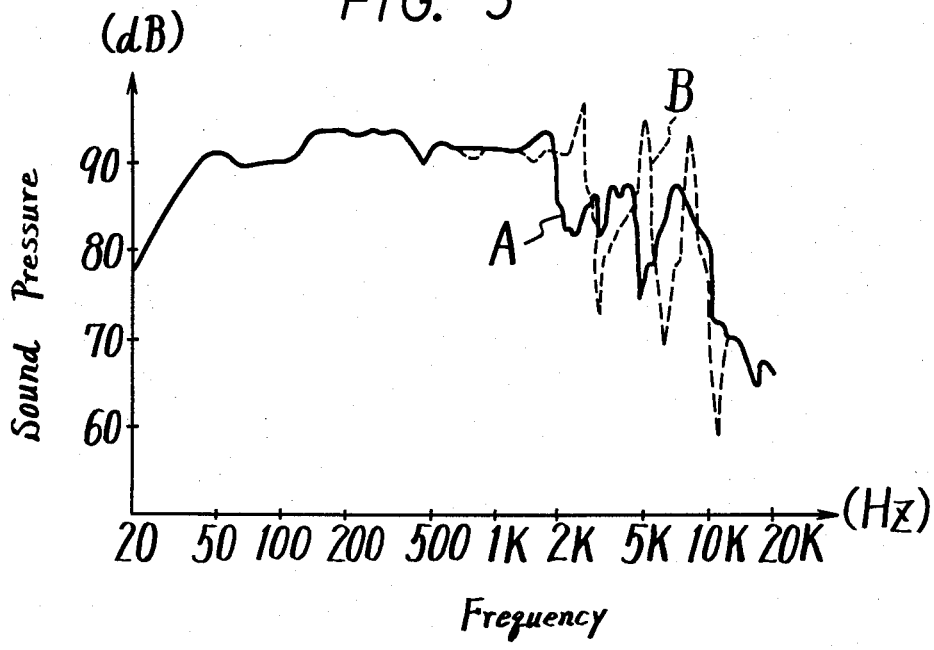
FIG. 5 is a graph showing the pressure-sound frequency characteristic for a conventional diaphragm with a honeycomb core structure and for a diaphragm according to this invention.

FIG. 5 is a graph showing the sound pressure-frequency characteristic for two loudspeakers having respective diaphragms with a well-known honeycomb core structure and a honeycomb core structure according to this invention. In FIG. 5, the solid line A represents characteristic for the diaphragm according to the present invention and the broken line B represents that of the well-known honeycomb diaphragm, respectively. As clearly understood from the graph of FIG. 5, with the diaphragm of this invention, the peaks and depth of the curve are remarkably decreased over a relatively wide high-frequency range centered around 5 $KH_z$ so as to produce a relatively smooth characteristic as compared with the prior art diaphragm. Therefore, it will be apparent that, according to this invention, due to this smooth characteristic, the sound quality is greatly improved over the prior art.

It is to be noted that the above example is only a preferred embodiment of this invention and, as such, does not limit the scope of this invention, which is defined by the claims. For example, it may be possible to use reinforced plastics such as carbon fibers, boron, boron alloy, mica, synthetic resin films or the like as the material for the sheet members.

Further, the present invention can be applied to a diaphragm of a conical or frusto-conical shape disclosed in addition to the flat shape disclosed above.

The diaphragm according to the present invention can also be applied to a microphone in addition to the loudspeaker described above.

Having described a specific embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

We claim as our invention:

1. A diaphragm for an electro acoustic transducer, comprising:

first and second sheet members;

a honeycomb core member sandwiched between said first and second sheet members; and a damping layer interposed between each said sheet member and said core member for increasing the internal energy loss of the diaphragm.

2. A diaphragm according to claim 1, wherein said damping layer is a foamed plastic material.

3. A diaphragm according to claim 2, wherein said damping layer is a urethane material.

4. A diaphragm according to claim 1, wherein said damping layer is a rubber material.

5. A diaphragm according to claim 1, wherein said damping layer is bonded to said honeycomb core member and to said sheet members by an adhesive agent containing a polyamide group.

6. A diaphragm according to claim 5, wherein said adhesive agent is in the form of a hot-melt-sheet.

7. A diaphragm according to claim 1, wherein said damping layer is of a material selected from the group consisting of aluminium, aluminium alloy, titanium, titanium alloy, boron, boron alloy, beryllium and fiber reinforced plastics.

8. A method of constructing a diaphragm for an electro acoustic transducer, comprising the steps of:

sandwiching a honeycomb core member between first and second sheet members;

interposing a damping layer between each said sheet member and said core member, wherein said damping layers increase the internal energy loss of the diaphragm; and bonding said damping layers to said core member and each said sheet member by an adhesive agent.

9. The method according the claim 8, wherein said adhesive agent is from the polyamide group.

10. The method according to claim 8, wherein said adhesive agent is in the form of a hot-melt-sheet interposed between each said damping layer, said sheet members and the core member, and said step of bonding includes heating said hot-melt-sheets under pressure so as to integrate said damping layers, sheet members and core member into a unitary structure.

* * * * *